US006196018B1

(12) United States Patent
Mori et al.

(10) Patent No.: US 6,196,018 B1
(45) Date of Patent: Mar. 6, 2001

(54) AIR CONDITIONER

(75) Inventors: Nobuyuki Mori; Osamu Nakamura; Yoshimi Kawai, all of Kanagawa-ken (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 09/251,735

(22) Filed: Feb. 18, 1999

(30) Foreign Application Priority Data

Mar. 16, 1998 (JP) ..... 10-084985

(51) Int. Cl.[7] ..... F25D 17/04; F24F 13/06

(52) U.S. Cl. ..... 62/404; 62/262; 454/313; 454/315

(58) Field of Search ..... 62/407, 411, 418, 62/DIG. 16, 404; 454/313, 321, 315, 188

(56) References Cited

U.S. PATENT DOCUMENTS 4,653,386 * 3/1987 Hayakawa et al. ..... 98/40.28
4,766,069 * 6/1998 Baek ..... 454/153
5,658,197 * 8/1997 Kil ..... 454/313 X
5,823,009 * 10/1998 Suzuki et al. ..... 62/411 X
5,888,133 * 3/1999 Mori et al. ..... 454/315 X

FOREIGN PATENT DOCUMENTS

402057855 * 2/1990 (JP) .
408110084 * 4/1996 (JP) .

* cited by examiner

*Primary Examiner*—Corrine McDermott
*Assistant Examiner*—Chen-Wen Jiang
(74) *Attorney, Agent, or Firm*—Kanesaka & Takeuchi

(57) ABSTRACT

A motor 51 is attached on the bottom surface side of a motor base 52 with a pinion gear 54 and an output gear 55 housed in a gear housing portion 521 thereof, and an output shaft 553 of the output gear 55 is inserted through a side plate 25L of an air outlet and is coupled to a flap 30 while the output shaft 553 is supported by a bearing hole 526 formed on the bottom portion of the motor base 52, and by a burring hole 251 formed at the side plate 25L. Therefore, the configuration of a flap driving means is simplified, the size is reduced, and the backlash of driving gears is controlled to smoothly drive the flap without rattling.

11 Claims, 15 Drawing Sheets

AIR CONDITIONER

BACKGROUND OF THE INVENTION

1. Field of the Invention

The present invention relates to an air conditioner, and more particularly, to the structure of a wind-directing-plate driving means attached in a large ceiling-mounted type of an indoor unit which is installed, for example, on the ceiling of a room, and to a wind directing plate which is preferable for a large indoor unit.

2. Description of the Related Art

Air conditioners are broadly divided into three types, that is, wall-mounted, floorstanding, and ceiling-mounted types, according to the ways they are mounted. Of these three types, the ceiling-mounted type of an air conditioner is mainly used in a larger space such as an office, and a store, to be placed on the ceiling. This type of an air conditioner is larger than, for example, a wall-mounted, or floorstanding type in structure, but has an advantage of effectively utilizing the space of a wall and a floor of a room.

Usually, a wind vertically directing plate (hereinafter, referred to as a flap) vertically rotatable around a horizontal axis of rotation, and a wind laterally directing plate (hereinafter, referred to as a louver) laterally rotatable around an axis of rotation almost perpendicular to the horizontal axis of rotation are disposed in an air outlet of an air conditioner. In the case of a ceiling-mounted type of a larger unit, its flap is , for example, 1500 mm in length, and 90 mm in width.

A flap and a louver are respectively driven by different motors, and the ways to drive them are broadly divided into two ways described below. One of them is to use a synchronous motor. With a synchronous motor, greater torque is obtained at a low cost, but there is a disadvantage of requiring a complicated link mechanism and a limit switch in order to control the position where its rotation stops and its rotational direction.

The other way is to use a stepping motor. A stepping motor with a gear reducer being incorporated therein is used for driving a wind directing plate, and usually its reduction gear ratio is about 1/40. A stepping motor allows complicated rotation control or the like without requiring a link mechanism or a limit switch.

However, a stepping motor has small output torque even with the aforementioned reduction gear ratio, therefore it has a disadvantage of insufficient torque for enduring external force when stopped without electric current, that is, insufficient detent torque, when the stepping motor is used for a large-sized flap applied especially to a ceiling-mounted type.

In order to compensate the aforementioned disadvantage, it is necessary to additionally carry out gear reduction outside. FIG. 17 shows the conventional example of the case in which gear reduction is additionally conducted outside. Based on this drawing, the configuration of a flap driving means will be explained. It should be mentioned that FIG. 17 is a cross-sectional view when a side plate portion of an air outlet is seen from the top of a housing.

According to the drawing, a flap driving means 1 is attached on a side plate 3 forming a part of an air outlet 2, and by this flap driving means 1, a flap 4 in the air outlet 2 is vertically driven rotatively around a horizontal axis of rotation X. Incidentally, the entire body of the flap driving means 1 is covered with a side cover 5 of the housing.

The flap driving means 1 includes a motor base 6 attached on the side plate 3. The motor base 6 has a first supporting base plate 6*a* in a size blocking an opening, which is for attaching the motor base, and which is formed on the side plate 3, a second supporting base plate 6*b* made almost vertical from the first supporting base plate 6*a* towards the outside surface of the side plate 3, specifically, the side cover 5 side, up to a predetermined height, and a third support base plate 6C bent to be parallel to the aforementioned first supporting base plate 6*a* from the upper end of the second supporting base plate 6*b*, all of which are made of synthetic resin.

The second supporting base plate 6*b* has a motor attaching frame 7 formed to be parallel to the aforementioned first supporting base plate 6*a*, and a stepping motor 8 having a gear reducer incorporated therein is secured to the frame 7 with screws with a driving shaft 8*a* thereof facing the third supporting base plate 6*c* side. A pinion gear 8*b* is secured to the driving shaft 8*a* with screws, and the third supporting base plate 6*c* is provided with a bush 9*a* serving as a bearing for the pinion gear 8*b*.

An output gear 10 meshed with the pinion gear 8*b* is provided between the first supporting base plate 6*a* and the third supporting base plate 6*c* of the motor base 6. An output shaft 10*a* is secured to the output gear 10 with screws. The output shaft 10*a* is located on the horizontal axis of rotation X of the flap 4, extending through the first supporting base plate 6*a* into the air outlet 2, and is coupled with the flap 4.

In this case, in order to keep the axis of the output gear 10 parallel to the axis of the pinion gear 8*b*, the third supporting base plate 6*c* is provided with a bearing bush 9*b*, and the first supporting base plate 6*a* is coaxially provided with a bearing hole 11 for the output shaft 10*a*. Incidentally, an E-ring (retaining ring) 12 is fitted onto the output shaft 10*a* at the position close to the bearing hole 11 in order to prevent rattling in the axial direction.

According to the flap driving means 1, the output from the stepping motor 8 is further reduced by the output gear 10, and is transmitted to the flap 4, thereby obtaining predetermined detent torque. However there are disadvantages described below.

First of all, due to a large number of components required, there is a disadvantage in assembling operability. Specifically, in the prior art, when coupling the pinion gear 8*b* to the driving shaft 8*a* of the stepping motor 8, and when coupling the output shaft 10*a* to the output gear 10, they are fastened with screws. Further, the third supporting base plate 6*c* of the motor base 6 needs to be provided with two of the bearing bushes 9*a* and 9*b* for the pinion gear 8*b* and the output gear 10.

Next, since the stepping motor 8 is held in the motor base 6, the motor base 6 itself needs to have a large size. Therefore, the flap driving means 1 becomes larger in size, and a larger space for attaching the same must be secured.

Further, the backlash of the inner gear of the stepping motor 8, the pinion gear 8*b*, and the output gear 10 appears as rattling of the flap 4. Especially when the flap 4 is rotated and its center of gravity is located above the horizontal axis of rotation X, the center of gravity is deviated according to the angle of the flap 4, therefore it seems that rattling occurs to the flap 4.

Meanwhile, in a larger unit like a ceiling-mounted type, its flap 4 needs to have for example, a length of 1500 mm and a width of 90 mm as described in the above. However, in order to obtain such a flap 4 by molding resin, slimmer molding die must be used, therefore it is difficult to secure the rigidity of the die. Accordingly, a larger-sized molding die compared to the molded flap 4 is used, therefore a large-sized injection machine must be used.

A slim cavity in a molding die doesn't allow smooth flow of resin material, thereby easily causing warp, sink, flow mark, weld, or the like. The aforementioned disadvantage is eliminated when using the flap 4 made of metal plate, but moisture condensation easily occurs to the flap 4 due to high thermal conductivity of the metal plate. Therefore, piled cloth or the like is set thereon, but in addition to high cost required, it is difficult to clean it when dust or the like is settled thereon. Further, metal plate is not preferable, since it is heavier than resin and gives an additional load to the motor.

SUMMARY OF THE INVENTION

The present invention is made to eliminate the aforementioned disadvantages, and its first object is to provide an air conditioner equipped with a flap driving means small in size with fewer parts and excellent assembling operability, which smoothly drives a flap without rattling.

The second object of the present invention is to provide a flap with excellent molding operability at lower molding cost, and especially preferable to a large-sized unit.

In order to attain the aforementioned first object, the present invention is an air conditioner provided with an almost box-shaped housing having an air inlet and an air outlet communicated with each other through an air passage inside including a heat exchanger and an air fan, with a wind vertically directing plate vertically rotatable around a horizontal axis of rotation being disposed inside said air outlet, and with a driving means for the aforementioned wind vertically directing plate being provided on an outer face of a side plate forming part of said air outlet. The aforementioned driving means, having a gear housing portion having a bottom with one side face being opened, includes a motor base attached on the outer face of the aforementioned side plate with the aforementioned open face opposing to the aforementioned side plate, and a motor attached on the outer face of the bottom of the aforementioned motor base with its driving shaft inserted into the aforementioned gear housing portion in which disposed are a pinion gear fitted onto the aforementioned driving shaft, and an output gear meshed with the aforementioned pinion gear directly or by the medium of an intermediate gear, with the output shaft thereof inserting through the aforementioned side plate, extending into the aforementioned air outlet, and coupled to the aforementioned wind vertically directing plate, and with both ends of the output shaft of the aforementioned output gear being supported by a bearing hole formed at the bottom of the aforementioned motor base and a burring hole formed at the aforementioned side plate.

According to the aforementioned configuration, the pinion gear and the output gear are housed in the gear housing portion of the motor base, and they are assembled by fitting to each other. Screwing work is required only when the motor base is attached to the side plate. Bushes serving as bearings for the pinion gear and the output gear are not needed.

In the present invention, a projecting portion to be in contact with the aforementioned side plate at a pinpoint portion is formed coaxially with the aforementioned pinion gear at the head portion side of the aforementioned pinion gear, opposing to the aforementioned side plate, thereby allowing the pinion gear to be held by the side plate with low friction. In this case, it is preferable that the aforementioned projecting portion is in a cone shape.

One of the characteristics of the present invention is that at the parts of the aforementioned driving shaft and a fitting hole of the aforementioned pinion gear corresponding to the driving shaft, flat faces formed to be parallel to the axial direction thereof are provided, and that markings parallel to the aforementioned flat faces are formed on the aforementioned projecting portion, thereby easily attaching the pinion gear onto the driving shaft.

Further, in order to define the rotation range of the flap, it is preferable to provide a stopper means for limiting the rotation range of the aforementioned output gear between the aforementioned output gear and the bottom portion of the aforementioned motor base.

Furthermore, in the present invention, the aforementioned output gear includes a sector gear which has a portion without teeth in the circumferential direction, with a stopper portion protruding to the bottom side of the aforementioned motor base being provided at one end of the gear portion, and with an arc-shaped rib facing the aforementioned stopper portion being formed on the bottom side of the aforementioned motor base almost along the length of the arc of the aforementioned portion without teeth. The aforementioned output gear is attached in the aforementioned gear housing portion with a proper rotational angle maintained by the aforementioned rib and the aforementioned stopper portion.

In the present invention, at least one of the aforementioned pinion gear and the aforementioned output gear is preferably formed of synthetic resin having self-lubricity, thereby enabling to drive the gear with low friction even if the bearing bushes are eliminated.

Further, the present invention is characterized by the aforementioned air outlet has a side opening and a bottom opening which are opened along the side face and the bottom face connecting thereto of the aforementioned housing. The aforementioned wind vertically directing plate is rotated by the aforementioned motor to each of the following positions: an initial position where the aforementioned wind vertically directing plate blocks the aforementioned bottom opening, middle positions where the aforementioned wind vertically directing plate is at the positions between the aforementioned bottom opening and the aforementioned side opening, and open positions where the aforementioned wind vertically directing plate is located above the virtual horizontal surface including the aforementioned horizontal axis of rotation. The aforementioned outlet gear has a spring means attached thereto which gives momentum to the aforementioned wind vertically directing plate in the direction of the aforementioned initial position when the aforementioned wind vertically directing plate is at least at the aforementioned open positions, thereby enabling to prevent rattling of the aforementioned wind vertically directing plate (flap).

It is preferable that the aforementioned spring means is composed of a coil spring fitted onto the output shaft of the aforementioned output gear, with one end of the coil spring being fixed to the aforementioned output gear, and with the other end thereof being engaged in a slit formed on the side wall of the aforementioned motor base.

In this case, it is preferable that the aforementioned slit is formed in the portion corresponding to the range where the aforementioned wind vertically directing plate is rotated from the aforementioned initial position to the position just before the aforementioned open position, and that the range corresponding to the portion where the slit is formed is designated as a lost motion range where the aforementioned coil spring is not worked.

Further in the present invention, it is preferable that a holding groove for engagingly holding the coil portion of the aforementioned coil spring is provided around the output shaft of the aforementioned output gear.

In order to attain the aforementioned second object, the present invention is an air conditioner provided with an almost box-shaped housing having an air inlet and an air outlet communicated with each other through an air passage inside including a heat exchanger and an air fan, with a wind vertically directing plate vertically rotatable around a horizontal axis of rotation inside the aforementioned air outlet, and with a driving means for the aforementioned wind vertically directing plate on an outer face of a side plate forming part of the aforementioned air outlet. The aforementioned wind vertically directing plate is composed of a coupled body formed by integrally coupling two of band-shaped wind directing plate members, which are formed to have almost equal lengths and widths to each other, in their longitudinal direction.

In this case, it is also one of the characteristics of the present invention that each of the aforementioned wind vertically directing members is composed of a body base plate and a back cover attached on the entire surface of the back of the aforementioned body base plate with an air space provided between the aforementioned body base plate and the back cover.

Further, it is preferable to have an engaging means, which elastically engages and couples the aforementioned body base plate and the aforementioned back cover, at an almost middle portion of each of the opposing faces of the aforementioned body base plate and the aforementioned back cover, thereby enabling to couple both of them by a so-called one-touch simple operation.

In the sense of securing a wider bonding area, it is preferable that either one member of the aforementioned body base plate or the aforementioned back cover is provided with ribs which have bonding faces to the other member and which are formed in the longitudinal direction at both ends in the width direction. Further, it is preferable that stepped grooves for engaging with the aforementioned ribs are formed on the aforementioned other member side.

It is preferable that the aforementioned body base plate and the aforementioned back cover are made of synthetic resin, and that thickness removed portions corresponding to the aforementioned ribs are provided on the surface of the aforementioned one member of the aforementioned body base plate and the aforementioned back cover. Thereby preventing so-called sink from occurring at the time of molding.

In the present invention hinge plates having rotating shafts coaxial with the aforementioned horizontal axis of rotation are provided at least at both end portions in the longitudinal direction of the aforementioned body base plate, and gaps for allowing the expansion of the aforementioned back cover caused by heat expansion are provided between the aforementioned hinge plates and the end faces of the aforementioned back cover.

With the gaps, the wind vertically directing plate is not warped even if warm air is blown to the back cover side, causing the back cover to expand when the wind vertically directing plate is set at an angle for blowing air downward especially at the time of heating operation.

Relating to the expansion of the back cover, it is preferable that an adhesive is partially applied to the bonding faces of the aforementioned ribs, and that both end portions in the width direction of the aforementioned body base plate and the aforementioned back cover are fixedly bonded with the aforementioned adhesive. Thus, the expansion of the back cover is not hindered by an adhesive, therefore the reaction force of the expansion force is not transmitted to the other members.

Further, in the present invention, it is preferable that a coupling means for the aforementioned one wind directing plate member and the aforementioned other wind directing plate member includes a pair of hinge plates provided at the end portions in the longitudinal direction of the aforementioned body base plates of the wind directing plate members to be engaged with each other while facing each other, and includes engaging hooks which are formed on the aforementioned one body base plate and inserted into the aforementioned other body base plate to be engaged, thereby enabling to easily couple both of the wind directing plate members with so-called one-touch fitting.

In this case, it is preferable that a fit recess in which the entire body of one of the aforementioned hinge plates is engaged is formed on the other one of the aforementioned hinge plates, thereby enabling to hide the coupled portion so as not to be seen from the outside.

Further, it is preferable that a female and male fitting means for positioning is provided on each of the opposing faces of the aforementioned fit recess and the aforementioned one of the hinge plates. Furthermore, in order to increase coupling strength, it is preferable that the aforementioned coupling means further includes tongue portions for bonding which are formed on the one of the aforementioned body base plates and are inserted into the other body base plate, in addition to the aforementioned engaging hooks.

DETAILED DESCRIPTION OF THE PREFERRED EMBODIMENT(S)

Figure 1:
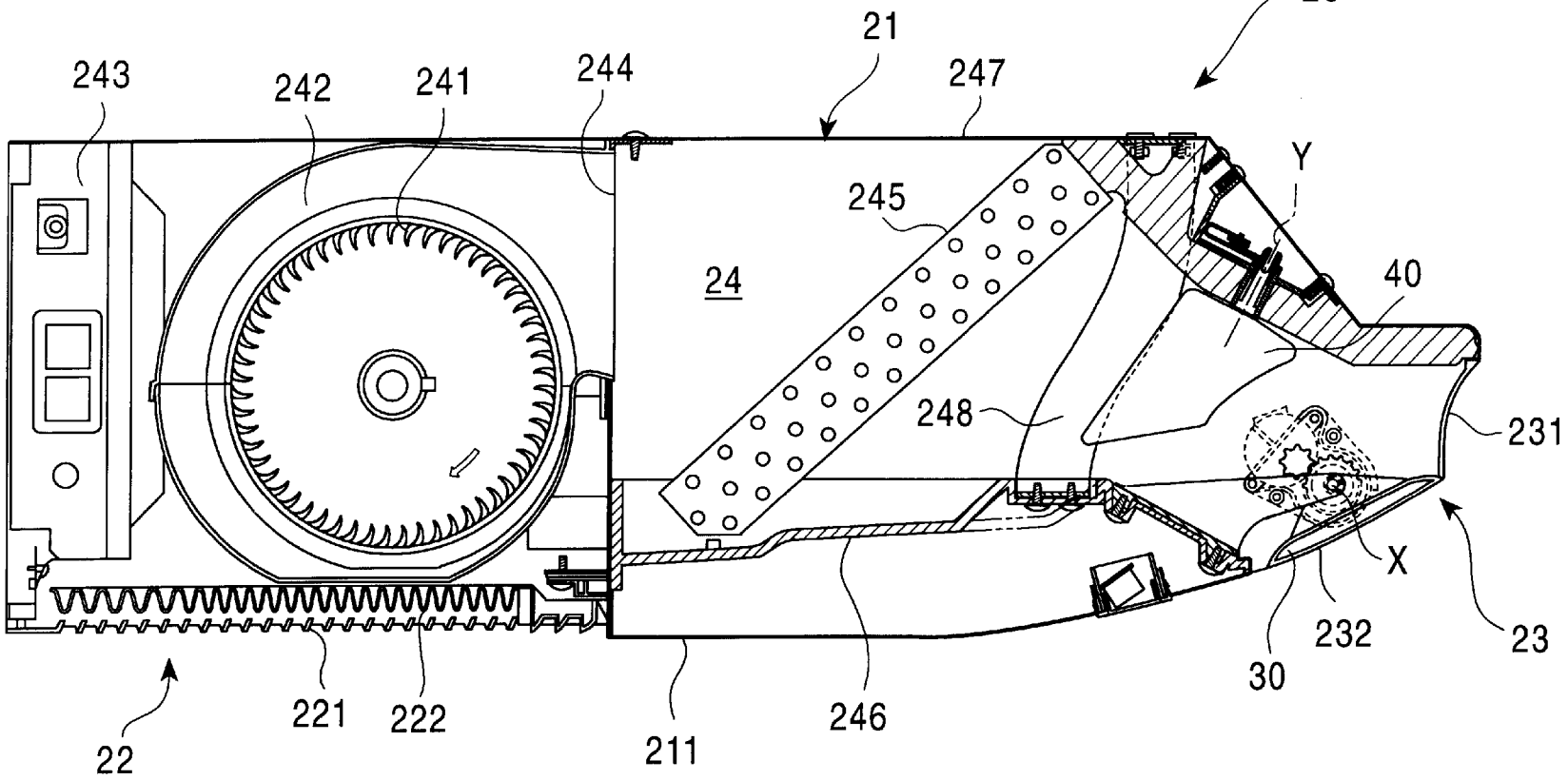
FIG. 1 is a sectional view showing a general configuration of an embodiment applied to a ceiling-mounted type of an air conditioner.

First, the general configuration of an air conditioner 20 will be explained based on FIG. 1. The air conditioner 20 in this embodiment is of a ceiling-mounted type, and a housing 21 thereof is formed in a flat box shape which is placed on the surface of a ceiling.

In this case, the bottom face of the housing 21 when viewed from a floor side forms a front panel 211. An air inlet 22 is provided at one end side of the front panel 211, and the air inlet 22 is provided with a decorative grill 221 and an anti-dust filter 222.

An air outlet 23 is formed at a corner portion of the housing 21 which is at the opposite end side to the air inlet 22. Specifically, the air outlet 23 includes a side opening 231 formed on the side face of the housing 21 and a bottom opening 232 formed at a part of the front panel 211 so as to connect to the side opening 231. Incidentally, FIG. 1 illustrates the state in which the bottom opening 232 is blocked by a flap 30 as a wind vertically directing plate.

The air inlet 22 and the air outlet 23 are communicated at an air passage 24 inside the housing 21. An air fan 241 is placed at the air inlet 22 side in the air passage 24 to be surrounded by a fan casing 242. An electrical equipment box 243 is provided at the side of the fan casing 242 in the housing 21.

In the air passage 24, a heat exchanger 245 is placed at an air blow opening 244 side of the fan casing 242 so as to oppose the air blow opening 244. Under the heat exchanger 245, a drain pan 246, which collects dewdrops dripping from the heat exchanger 245, is provided. A supporting beam 248 forming the frame of the housing 21 is laid across the drain pan 246 and a top plate 247 of the housing 21.

In the air outlet 23, placed are the flap (wind vertically directing plate) 30 rotating around a horizontal axis of rotation X, and a louver (wind horizontally directing plate) 40 which is rotatable in a horizontal direction around an axis of rotation Y almost perpendicular to the aforementioned horizontal axis of rotation X. In the embodiment, only one flap 30 is used. As for the louver 40, only one is illustrated in FIG. 1, but actually, a plurality of them is provided in a direction perpendicular to the surface of the paper of the same drawing.

Figure 2:
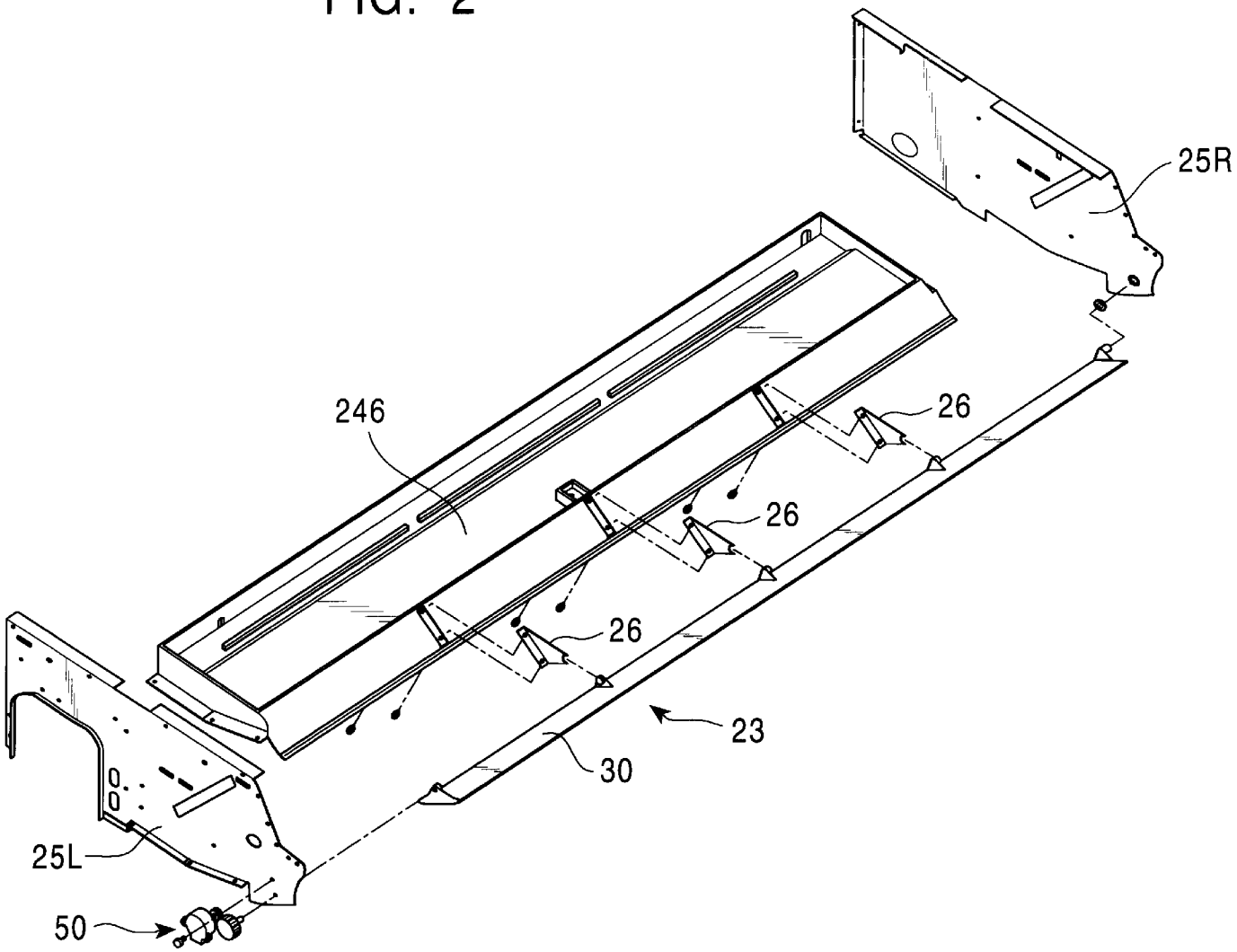
FIG. 2 is an exploded perspective view of an air outlet portion in the aforementioned air conditioner.

As FIG. 2 illustrates, the air outlet 23 is surrounded by a pair of right and left side plates 25L and 25R, and a part of the top plate 247 (see FIG. 1). One of the side plates, 25L, is provided with a flap driving means 50 for rotationally driving the flap 30. Incidentally, supporting plates 26 for supporting the portions between both ends of flap 30 are placed with a predetermined space from each other at the front end edge of the drain pan 246 which faces the air outlet 23.

Figure 3:
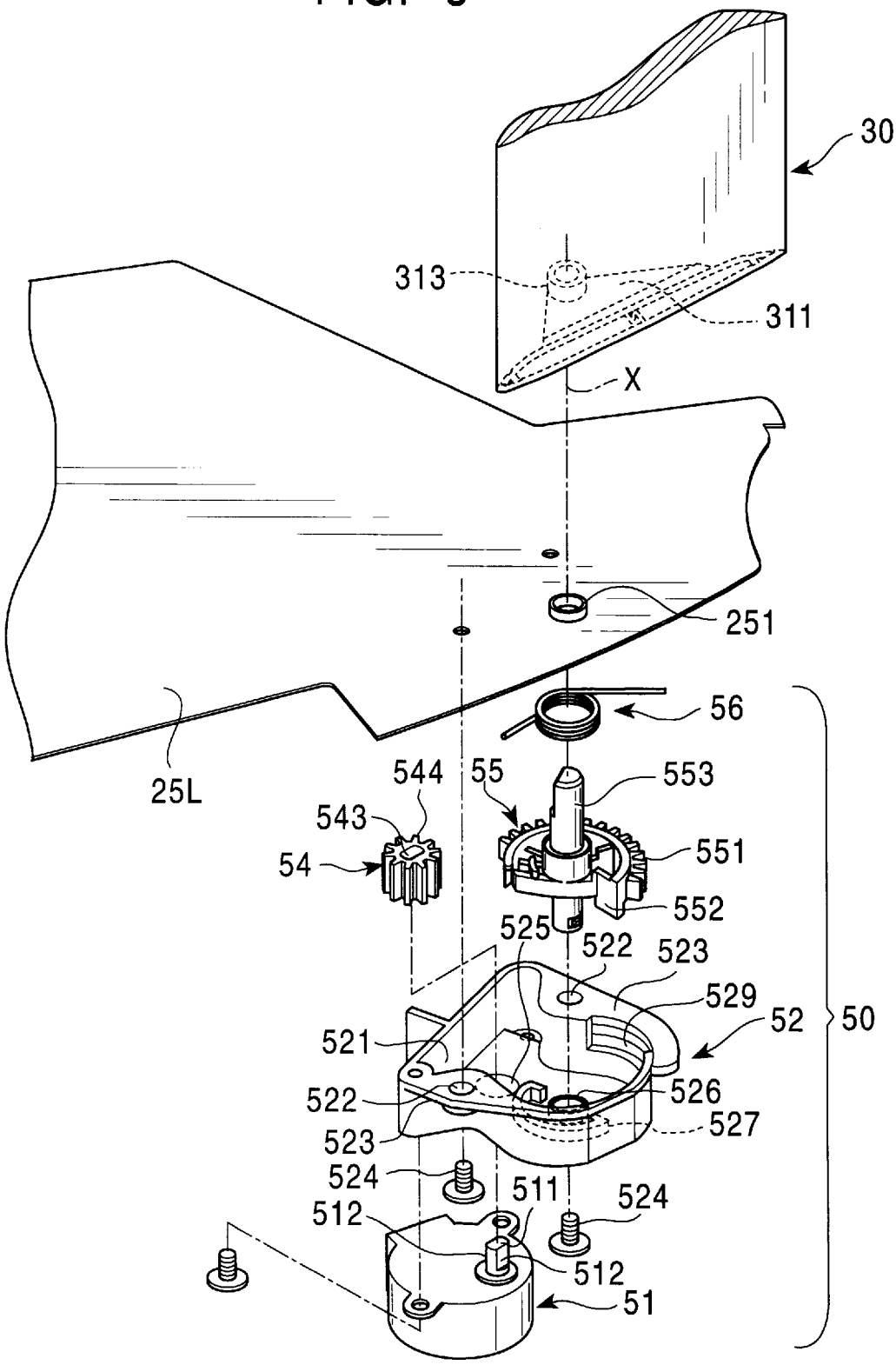
FIG. 3 is an exploded perspective view of a flap driving means attached to the aforementioned air outlet portion.

As FIG. 3 illustrates, the flap driving means 50 includes a stepping motor 51, a motor base 52 which is attached at the side plate 25L while supporting the stepping motor 51, and a pinion gear 54 and an output gear 55 which are incorporated in the motor base 52.

Figure 4A:
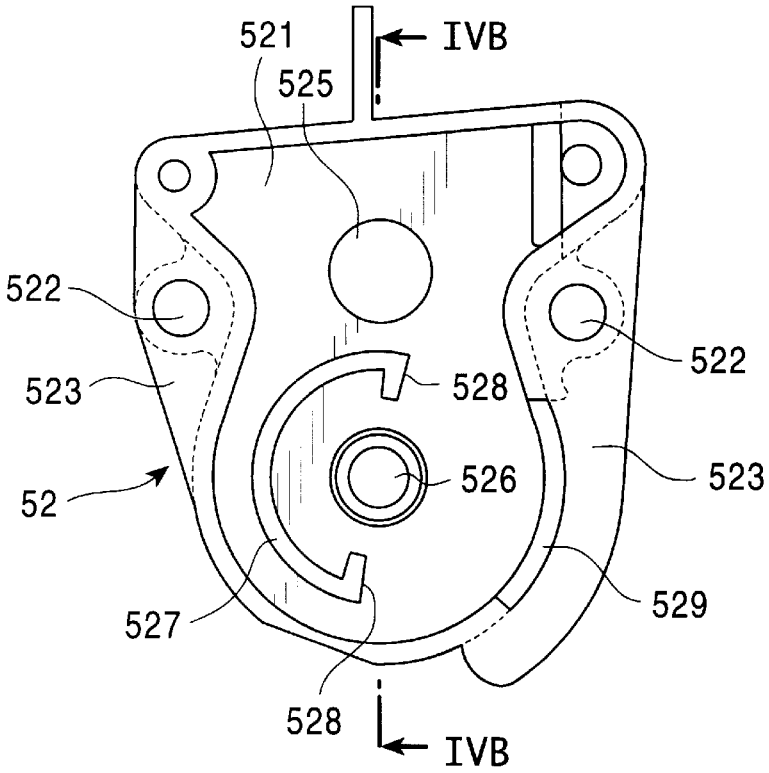
FIG. 4A is a plan view of a motor base used in the aforementioned flap driving means.
Figure 4B:
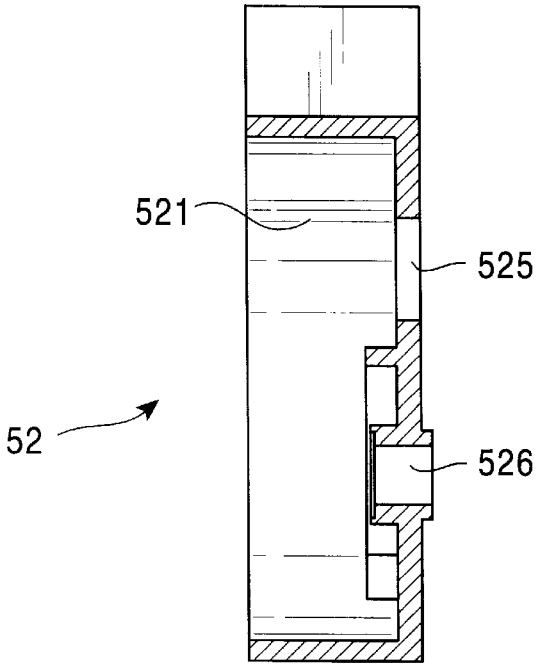
FIG. 4B is a sectional view taken along a IV B—IV B line in FIG. 4A.

Referring to FIG. 4A, a plan view of the motor base 52, together with FIG. 4B, a sectional view taken along a IVB—IVB line, the motor base 52 includes a gear housing portion 521 having a bottom with one end face open. At the peripheral edge of the open face, provided are flanges 523 having screw insertion holes 522. With fastening screws being inserted through the screw insertion holes 522, the motor base 52 is fixed on the outer face of the side plate 25L with its open face opposing the side plate 25L.

Two of shaft insertion holes 525 and 526 are provided on the bottom portion of the gear housing portion 521. The insertion hole 525 is for inserting a driving shaft 511 of the stepping motor 51, and the stepping motor 51 is secured to the outer surface of the bottom of the motor base 52 with screws with its driving shaft 511 inserted through the shaft insertion hole 525.

In the gear housing portion 521, the pinion gear 54 is attached to the driving shaft 511 of the stepping motor 51. In this case, on the driving shaft 511, a pair of flat faces 512 and 512, which are parallel to each other along the axial direction, are formed to face to each other.

Figure 6A:
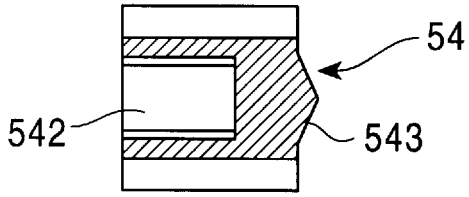
FIG. 6A is a sectional view showing a pinion gear used in the aforementioned flap driving means.
Figure 6B:
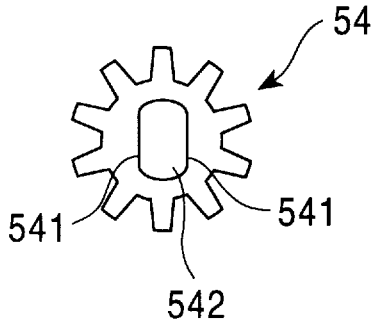
FIG. 6B is a bottom view thereof with FIG. 6C being a plan view thereof.

Relative to the driving shaft 511, the pinion gear 54 is constructed as follows. Specifically, as is shown in the sectional view in FIG. 6A, and the bottom view in FIG. 6B, a bearing hole 542, which has a pair of flat faces 541 and 541 matching to the flat surfaces 512 and 512 of the driving shaft 511, is formed in the pinion gear 54. With the bearing hole 542, the pinion gear 54 is fitted on to the driving shaft 511 so as to be integrally rotated.

Figure 5:
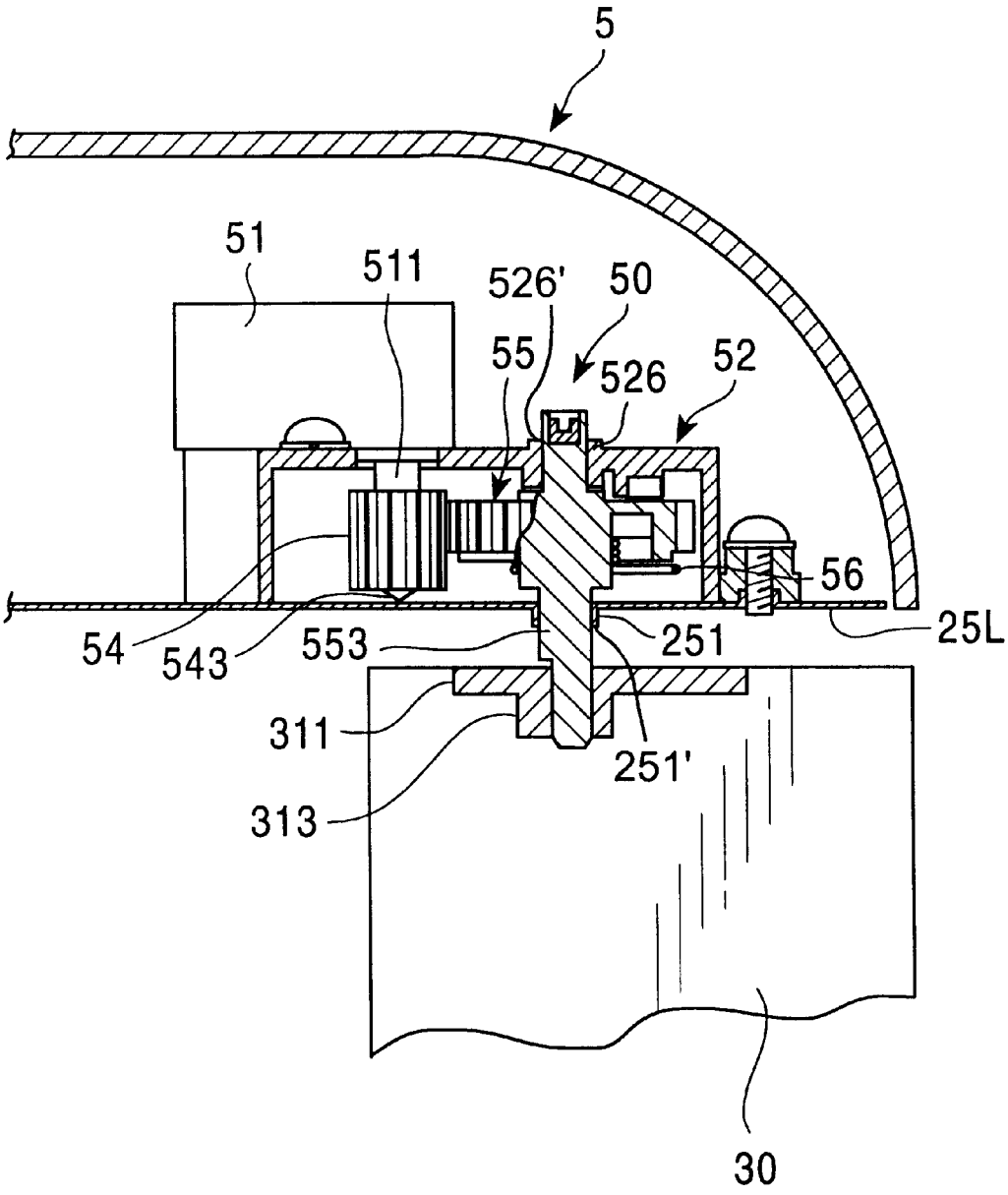
FIG. 5 is a sectional view of a state in which the aforementioned flap driving means is assembled.

In the present invention, fastening means such as screws are not provided between the driving shaft 511 of the stepping motor 51 and the pinion gear 54. As FIG. 5 illustrates, the pinion gear 54 is prevented from slipping off the driving shaft 511 by holding the head portion of the pinion gear 54 with the side plate 25L when the motor base 52 is attached to the side plate 25L.

As a result, the head portion of the pinion gear 54 is in contact with the side plate 25L, therefore in order to reduce the contact friction resistance, a cone-shaped projecting portion 543 is formed at the head portion of the pinion gear 54 to be coaxial with the pinion gear 54. In the embodiment, the pinion gear 54 is formed of synthetic resin (for example, polyacetal resin containing a lubricating component) of low friction having self-lubricity.

The bearing hole 542 of the pinion gear 54 is not a through-hole, but a blind hole with its bottom blocked, therefore when fitting the pinion gear 54 onto the driving shaft 511, it is necessary to confirm the positional relationship between the flat faces 541 and 541, and the flat faces 512 and 512 of the driving shaft 511 by looking at the bearing hole 542 of the pinion gear 54, so that the assembling operation becomes troublesome.

Figure 6C:
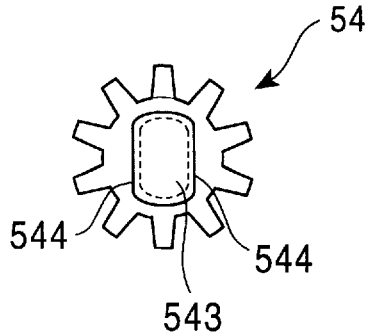

Accordingly, as FIG. 6C illustrates, in this embodiment, cut faces 544 and 544 parallel to the flat faces 541 and 541 are formed at the bottom portion of the projecting portion 543 of the pinion gear 54 so that the proper alignment with the flat faces 512 and 512 of the driving shaft 511 can be easily obtained. Incidentally, a marking such as a simple line can be given instead of the cut faces.

Figure 7A:
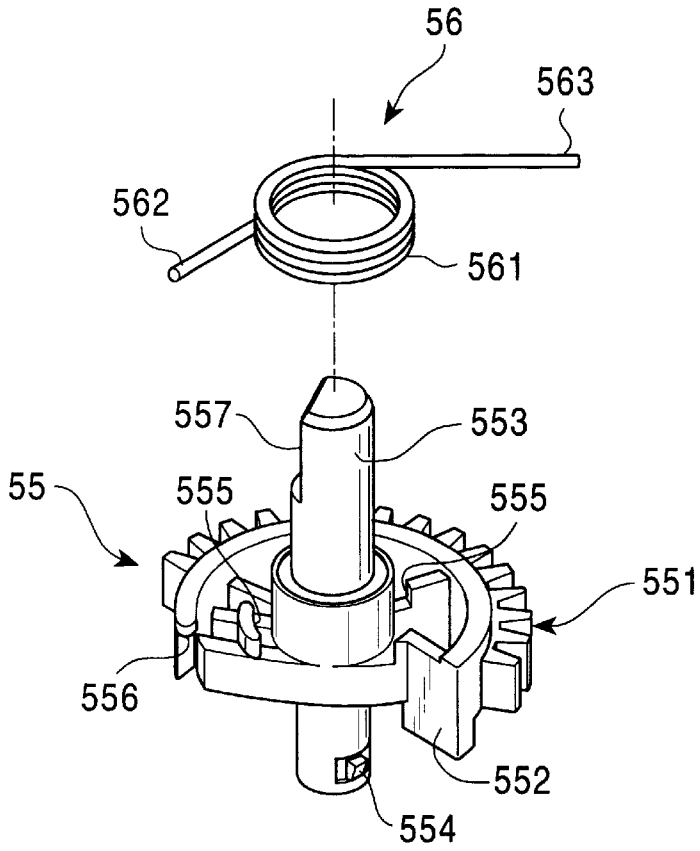
FIGS. 7A and 7B are perspective views showing an output gear used in the aforementioned flap driving means.

As is clearly illustrated in FIG. 7A, a sector gear, a gear with a portion being cut out along the circumferential direction to have no teeth (portion without teeth), is used for the output gear 55. A stopper portion 552 projecting to the bottom side of the motor base 52 is provided at one end of a gear portion 551.

Meanwhile, a rib 527 facing the stopper portion 552 of the gear portion 551 is formed in an arc form on the bottom side of the motor base 52 almost along the entire length of the circular arc of the aforementioned portion without teeth (see FIG. 4A). The rib 527 is formed along a part of the circumference with which the stopper portion 552 draws, and both ends of the rib 527 form abutting stop faces 528 and 528 against the stopper portion 552.

The output gear 55 is attached into the motor base 52 by fitting one end of an output shaft 553 in the shaft insertion hole 526. In this case, the output shaft 553 cannot be fitted in the shaft insertion hole 526 unless the stopper portion 552 is placed outside the area in which the rib 527 is formed.

Specifically, with the rib 527 and the stopper portion 552, an improper insertion by which the portion without teeth of the output gear 55 faces the pinion gear 54 is prevented. Only when the stopper portion 552 is placed outside the area in which the rib 527 is formed, the output gear 55 can be attached into the gear housing portion 521 of the motor base 52 with a proper rotational angle at which the gear portion 551 can mesh with the pinion gear 54.

When the output gear 55 is properly attached in the gear housing portion 521 as described above, the output gear 55 is laid on the rib 527 to rotate on the rib 527. The output shaft 553 is provided with a retractile claw 554 for temporary fastening at one end thereof, and thereby preventing the output shaft 553 from slipping off the shaft insertion hole 526 at the time of the assembling operation. The output gear 55 is also formed of synthetic resin (for example, polyacetal resin containing lubricant component) of low friction having self-lubricity.

To the output gear 55 attached is a coil spring 56 for eliminating backlash occurring at the portions where the inner gear of the stepping motor 51, the pinion gear 54, and the output gear 55 mesh with one another.

Figure 7B:
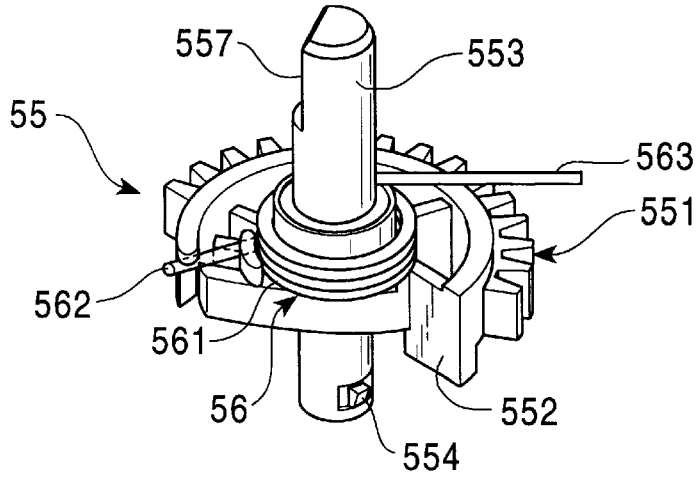

A holding groove 555 for fittingly holding a coil portion 561 of the coil spring 56 is provided around the output shaft 553 of the output gear 55, and thereby coaxially holding the coil spring 56 around the output shaft 553, as shown in FIG. 7B. One end portion 562 of the coil spring 56 is engagingly stopped by an engaging hook 556 provided at the other end (the end portion opposite to the stopper portion 552) of the gear portion 551 while other end 563 of the coil spring 56 is engaged in a slit 529 formed on the side wall of the motor base 52.

Next, the assembly procedures of the flap driving means 50 will be explained with reference to FIGS. 3 and 5, and the operation of the coil spring 56 will be described thereafter. First, the stepping motor 51 is attached on the outer surface of the bottom of the motor base 52. Then, the pinion gear 54 is fitted onto the driving shaft 511 of the stepping motor 51 in the gear housing portion 521 of the motor base 52. At this time, the pinion gear 54 is easily fitted onto the driving shaft 511 by referring to the cut face 544 formed on the head portion of the pinion gear 54 as a guide to the fitting direction.

Next, with the coil spring 56 being attached onto the output gear 55, the output gear 55 is attached in the gear housing portion 521 of the motor base 52, and the end portion 563 of the coil spring 56 is engaged in the slit 529 of the motor base 52. At this time, if the output gear 55 is rotated so that the stopper portion 552 of the gear portion 551 does not abut to the rib 527, the gear portion 551 will be surely guided to the position at which it meshes with the pinion gear 54.

It goes without saying that the pinion gear 54 may be fitted onto the driving shaft 511 of the stepping motor 51 after the output gear 55 has been attached in the gear housing portion 521. The coil spring 56 may also be attached onto the output gear 55 after the output gear 55 has been attached in the gear housing portion 521 of the motor base 52.

After each member is attached in the motor base 52 as described above, the open face side of the motor base 52 is attached at the side plate 25L and fastened with screws. In the present invention, a bearing for the output shaft 553 of the output gear 55 is prepared on the side plate 25L side.

Specifically, the bearing is composed of a burring hole 251, and the output shaft 553 of the output gear 55 is supported by a flange 251' of the burring hole 251 and a flange 526' of the shaft insertion hole 526 of the motor base 52 side. The end portion of the output shaft 553 is provided with a coupling portion 557 including a flat portion which is formed by making a part of the end portion parallel to the axial direction. The output shaft 553 is coupled to the flap 30 by means of the coupling portion 557.

Here, the operations of the flap 30 and the aforementioned coil spring 56 will be explained with reference to FIG. 8 to FIG. 12. The flap 30 is rotated by the driving means 50 to each of the following positions: the initial position in FIG. 8 in which the flap 30 blocks the bottom opening 232 of the air outlet 23, the middle positions in FIGS. 9 and 10 in which the flap 30 is positioned between the bottom opening 232 and the side opening 231, the open position in FIG. 11 in which the flap 30 is positioned above an virtual horizontal surface XA including the aforementioned horizontal axis of rotation X, and the totally open position in FIG. 12.

In the present invention, the coil spring 56 gives momentum to the flap 30 in a direction in which the flap 30 blocks the bottom opening 232 with its own weight, specifically, in a direction in which the flap 30 moves to the initial position from the totally open position. Contrary to the above, if the momentum of the coil spring 56 is given in the inverse direction, specifically, if the momentum is given to the totally open position side from the initial position, it will not be preferable when the flap is moved to the initial position in FIG. 8 from the middle position, for example, in FIG. 9, since much greater torque is needed in the stepping motor 51 to overcome the momentum of the coil spring 56.

Figure 9:
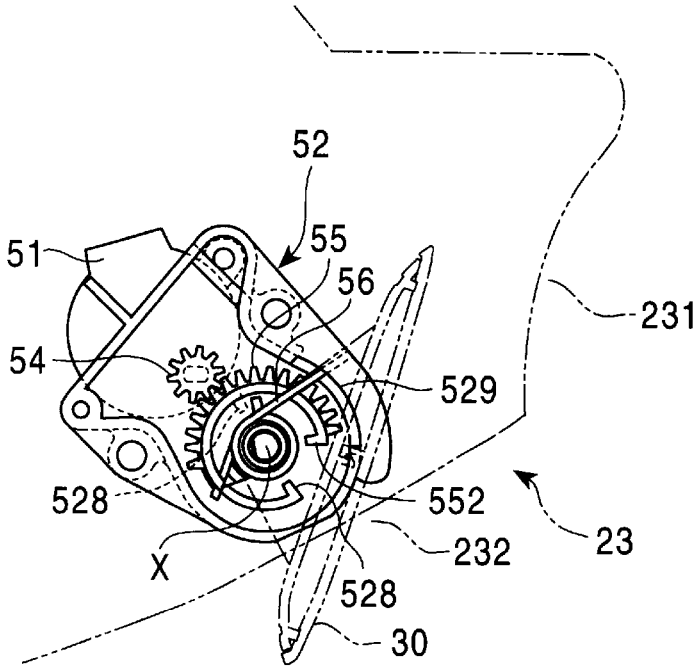

However, even when the momentum of the coil spring 56 is given in a direction (a clockwise direction in each of the aforementioned drawings) in which the flap 30 blocks the bottom opening 232, if the momentum is given in the entire range, torque generated by own weight of the flap 30 will be added to the torque of the momentum of the coil spring 56, for example, in the middle position in FIG. 9, therefore the detent torque of the stepping motor 51 may sometimes yield to the total amount of the torque even if the gear reduction is carried out.

Figure 11:
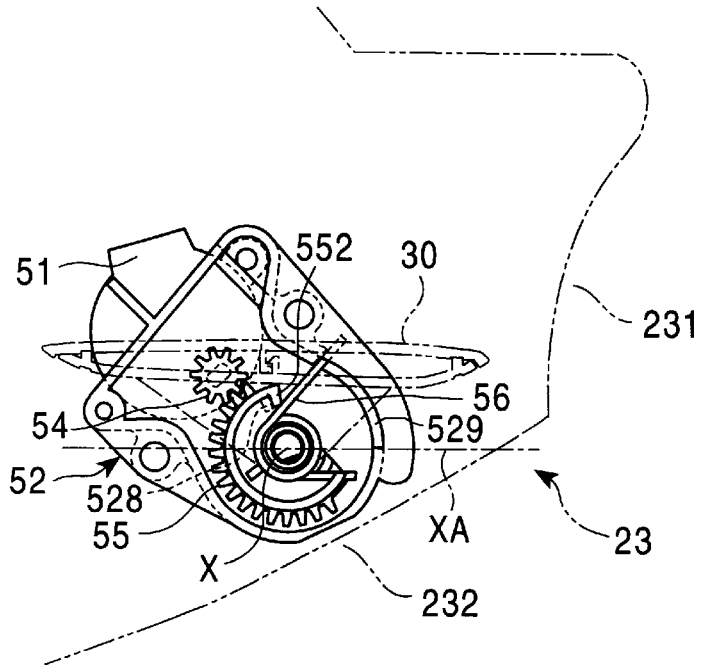

In the vicinity of the open position in FIG. 11 in which the center of gravity of the flap 30 passes directly above the horizontal axis of rotation X, rattling (shaking) occurs to the flap 30 caused by backlash occurring to the portion where the inner gear of the stepping motor 51, the pinion gear 54, and the output gear 55 mesh with one another.

Figure 8:
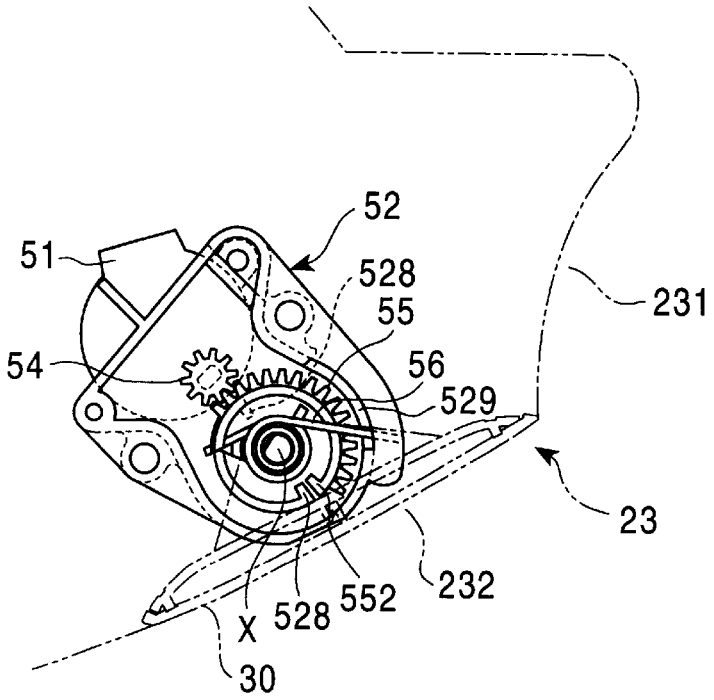
FIG. 8 to FIG. 12 are explanatory views of the operations of the aforementioned flap driving means.
Figure 10:
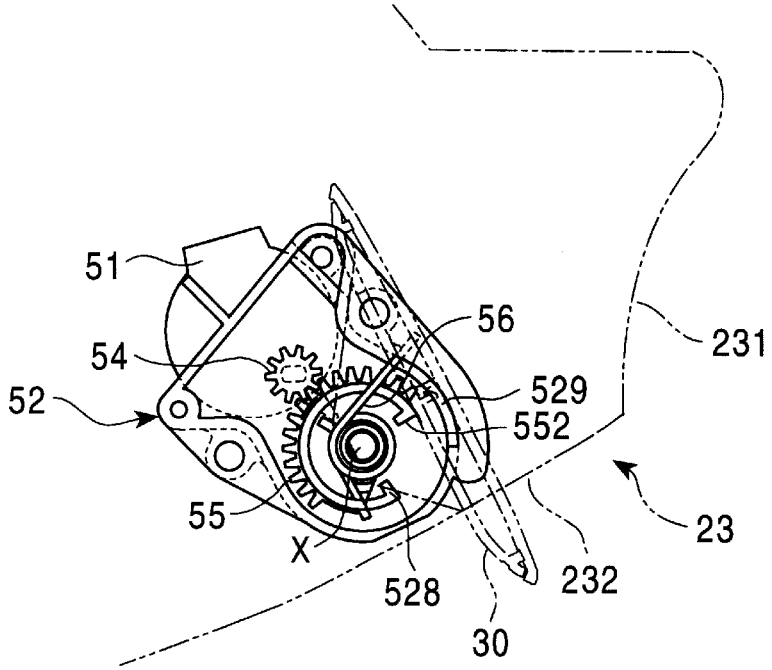

Accordingly, in the present invention, the momentum of the coil spring 56 is designed not to act on the flap 30 when the flap 30 is at the positions from the initial position in FIG. 8 to the middle position (downward blowing position), for example, in FIG. 10.

Specifically, with the other end portion 563 of the coil spring 56 being engaged in the slit 529 of the motor base 52, the other end portion 563 of the coil spring 56 simply moves in the slit 529 when the flap 30 is at the positions from the initial position in FIG. 8 to the midpoint position in FIG. 10. This is so-called lost motion range by the slit 529.

When the flap 30 is further rotated from the middle position in FIG. 10 to the open position in FIG. 11, the other end portion 563 of the coil spring 56 abuts to the end wall of the slit 529, and the coil spring 56 begins to be deformed to add the momentum to the flap 30.

Figure 12:
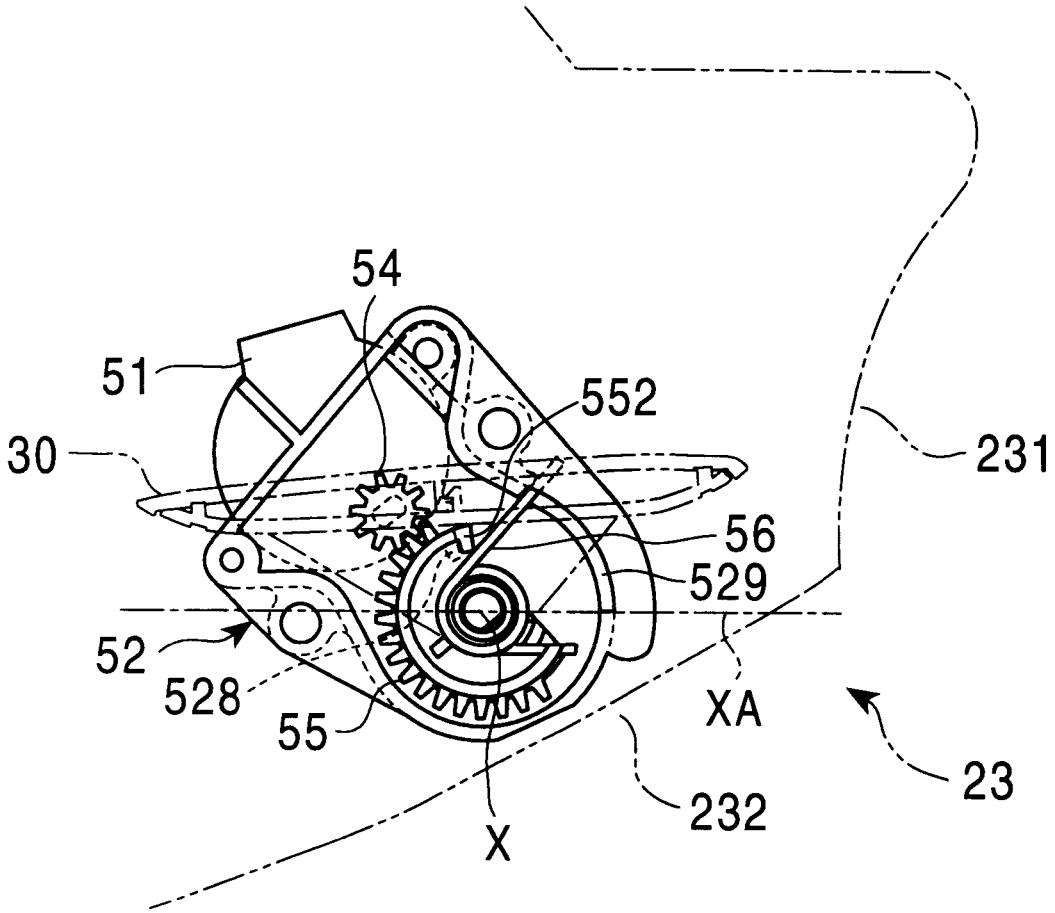

In this way, excessive load is not applied to the stepping motor 51, and rattling of the flap 30 in the vicinity of the open position in FIG. 11 is prevented. It should be mentioned that the initial position of the flap 30 in FIG. 8 and the full open position of the flap 30 in FIG. 12 are regulated by the stopper portion 552 of the output gear 55 and the abutting stop faces 528 and 528 of the rib 527 of the stepping motor base 52 side.

Figure 13:
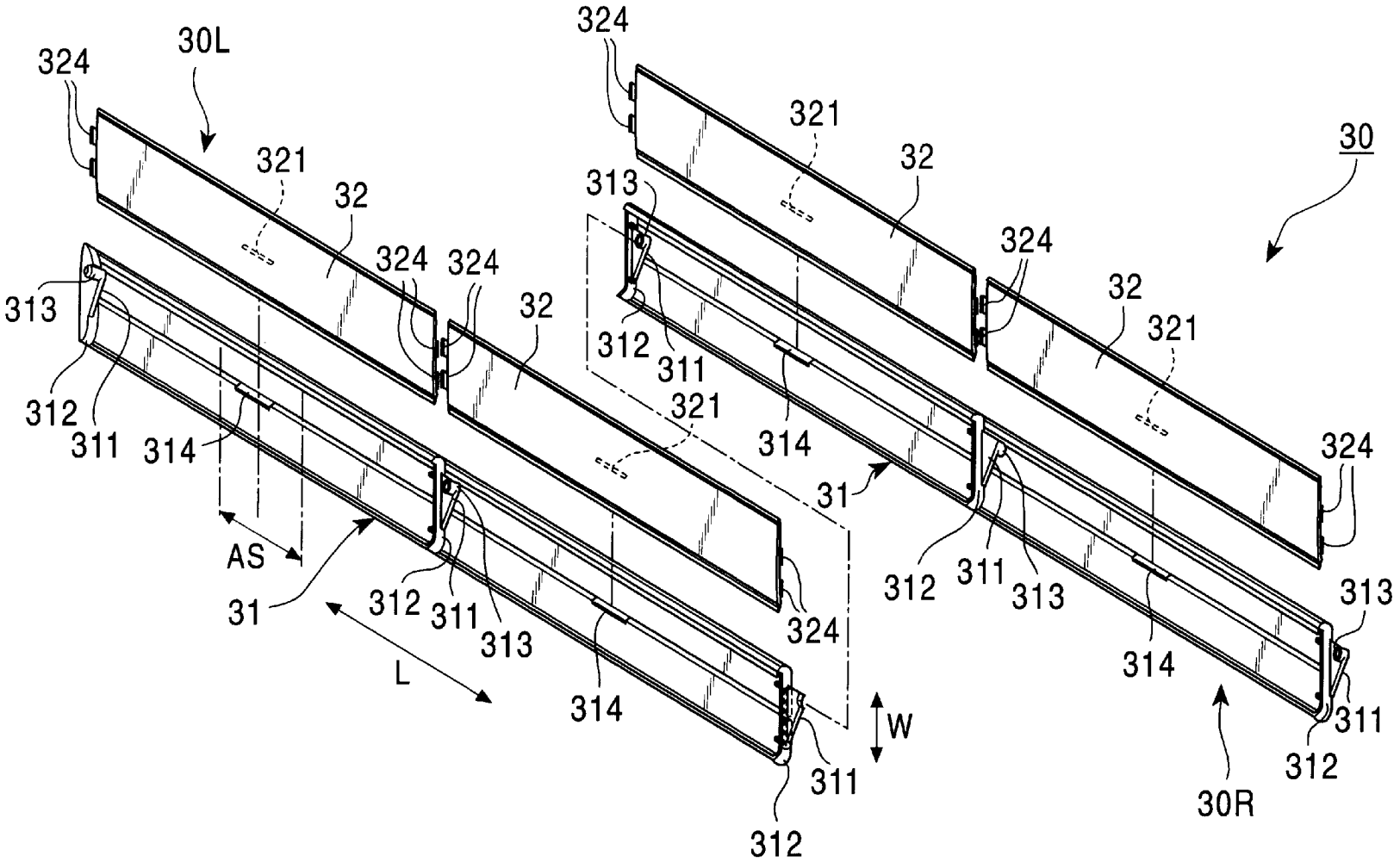
FIG. 13 is an exploded perspective view showing an embodiment of the flap according to the present invention.

Next, as shown in FIG. 13, the aforementioned flap 30 is composed of a coupled body formed by integrally coupling two of band-shaped wind directing plate members 30L and 30R formed equally in length and width, in their longitudinal direction.

In the embodiment, each of the wind directing plate members 30L and 30R has almost the same structure except for their coupling portion, therefore one of the wind directing plate members, 30L, will be explained here, and the explanation of the other wind directing plate member 30R will be omitted by using the same reference numerals to designate the same or similar components as those in the wind directing plate member 30L.

The wind directing plate member 30L is composed of a body base plate 31 and a back cover 32 attached on the entire back surface of the body base plate 31 with a cavity between them. Here, when the longitudinal direction of the flap 30 is L, and the width direction thereof is W, hinge plates 311 are respectively provided at both ends and the central portion of the body base plate 31 in the longitudinal direction L in this embodiment.

The hinge plate 311 has a rotating shaft 313 positioned on the horizontal axis of rotation X of the flap 30, and is laid on a beam member 312 in the width direction W of the body base plate 31. The back of the body base plate 31 is virtually divided into two parts at the central hinge plate 311, and consequently two of the back covers 32 and 32 are correspondingly attached to the back of the body base plate 31.

Figure 14:
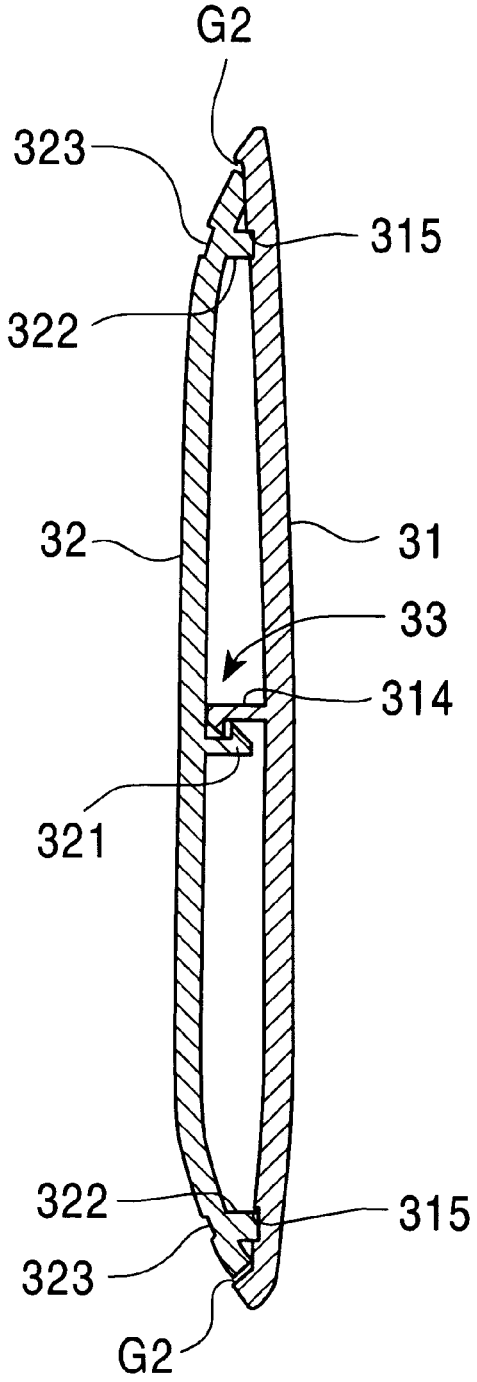
FIG. 14 is a longitudinal sectional view of the aforementioned flap.

The back covers 32 and 32 have the same structures, and when referring to FIG. 14, an engaging means 33 for elastically engaging and coupling the body base plate 31 and the back cover 32 is provided at an almost central portion of each of the opposing faces of the base body plate 31, and the back cover 32. In this embodiment, the engaging means 33 consists of a sagittal engaging hook 314 formed on the body base plate 31 side, and a sagittal engaging hook 321 formed on the back cover 32 side, and they are coupled with so-called one-touch simple operation.

At both end portions in the width direction W in each of the back covers 32, ribs 322 and 322 having bond surfaces to the body base plate 31 are formed along the longitudinal direction L. After the bond surfaces are coated with an adhesion, the body base plate 31 is integrally connected to the back cover 32 with the aforementioned engaging means 33. Stepped grooves 315 and 315 for engaging with the ribs 322 and 322 are formed on the body base plate 31 side, thereby facilitating the positioning of the body base plate 31 and the back cover 32.

The body base plate 31 and the back cover 32 are formed by injection molding of synthetic resin. Therefore, a thickness removed portion 323 is provided correspondingly to the rib 322, thereby preventing so-called sink occurring at the time of molding.

Figure 15:
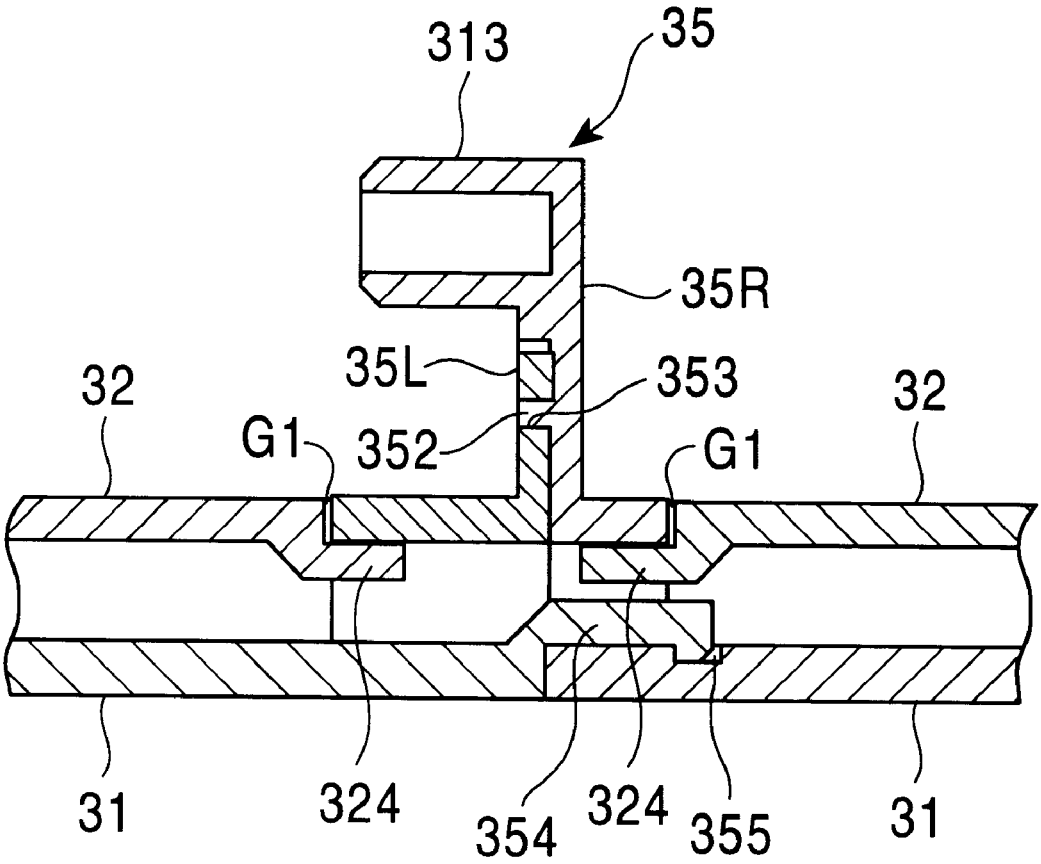
FIG. 15 is a sectional view showing a coupled portion of the aforementioned flap.

At both ends in the longitudinal direction L, each of the back covers 32 has engaging portions 324 and 324 corresponding to the hinge plates 311, and as is shown in FIG. 15, the engaging portions 324 and 324 are sunk under the bottom face of the beam member 312 to be fitted with the hinge plates 311 and 311 between them.

Especially at the time of heating operation, when the flap 30 is set at an angle for downward blowing as shown in FIG. 10 which is described above, warm air is mainly blown to the back cover 32 side, therefore the temperature of the back cover 32 is higher than that of, for example, the body base plate 31 by about 16° C.

Here, when the materials of both of them are ABS resin, its linear expansion coefficient is $7\times10^5$, therefore when, for example, the length of a span is 370 mm, the expansion of the back cover 32 is as much as 0.73 mm while the body base plate 31 expands 0.31 mm, so that the expansion difference is 0.42 mm. For information, when the length of a span is 1500 mm, the difference reaches 2.4 mm.

Accordingly, in the present invention, as shown in FIG. 15, a gap G of, for example, 0.5 mm to 1.0 mm for allowing the expansion of the back cover 32 caused by heat expansion is provided between the beam member 312 of the hinge plate 311 and the end surface of the back cover 32, thereby preventing warpage from occurring to the back cover 32.

In addition, when the back cover 32 is bonded to the body base plate 31 by applying an adhesive to the bond surface of the rib 322, the bonding area is limited to be partial to allow the back cover 32 to expand easily, thereby preventing the reaction force of the expansion force from being transmitted to the body base plate 31. In the embodiment, as shown in FIG. 13, the partial bonding area AS is limited to the area of about 60 mm in the central portion of the back cover 32.

Further, in the embodiment, as shown in FIG. 14, gaps G2 and G2 are respectively provided between both ends in the width direction W of the back cover 32 and both ends in the width direction W of the body base plate 31 to allow the expansion of the back cover 32 caused by heat expansion.

Next, with reference to a sectional view in FIG. 15 together with an exploded perspective view in FIG. 16, the structure of a coupling means 35 for wind directing plate members 30L and 30R will be explained. The coupling means 35 is formed between the hinge plate 311 provided at the right end of the wind directing plate member 30L and the hinge plate 311 provided at the left end of the wind directing plate member 30R in FIG. 13 described above.

Figure 16:
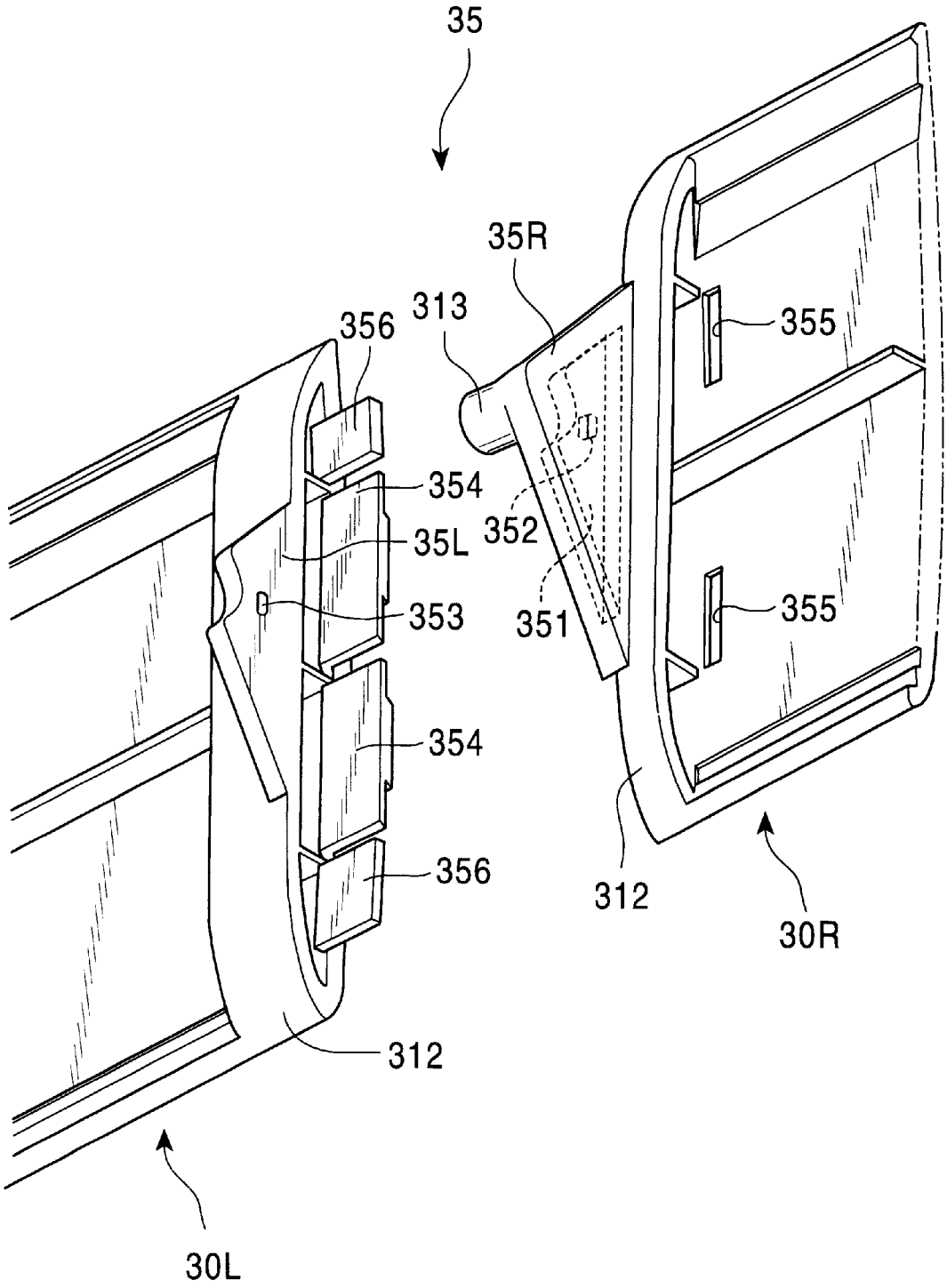
FIG. 16 is an exploded perspective view showing the coupled portion of the aforementioned flap.
Figure 17:
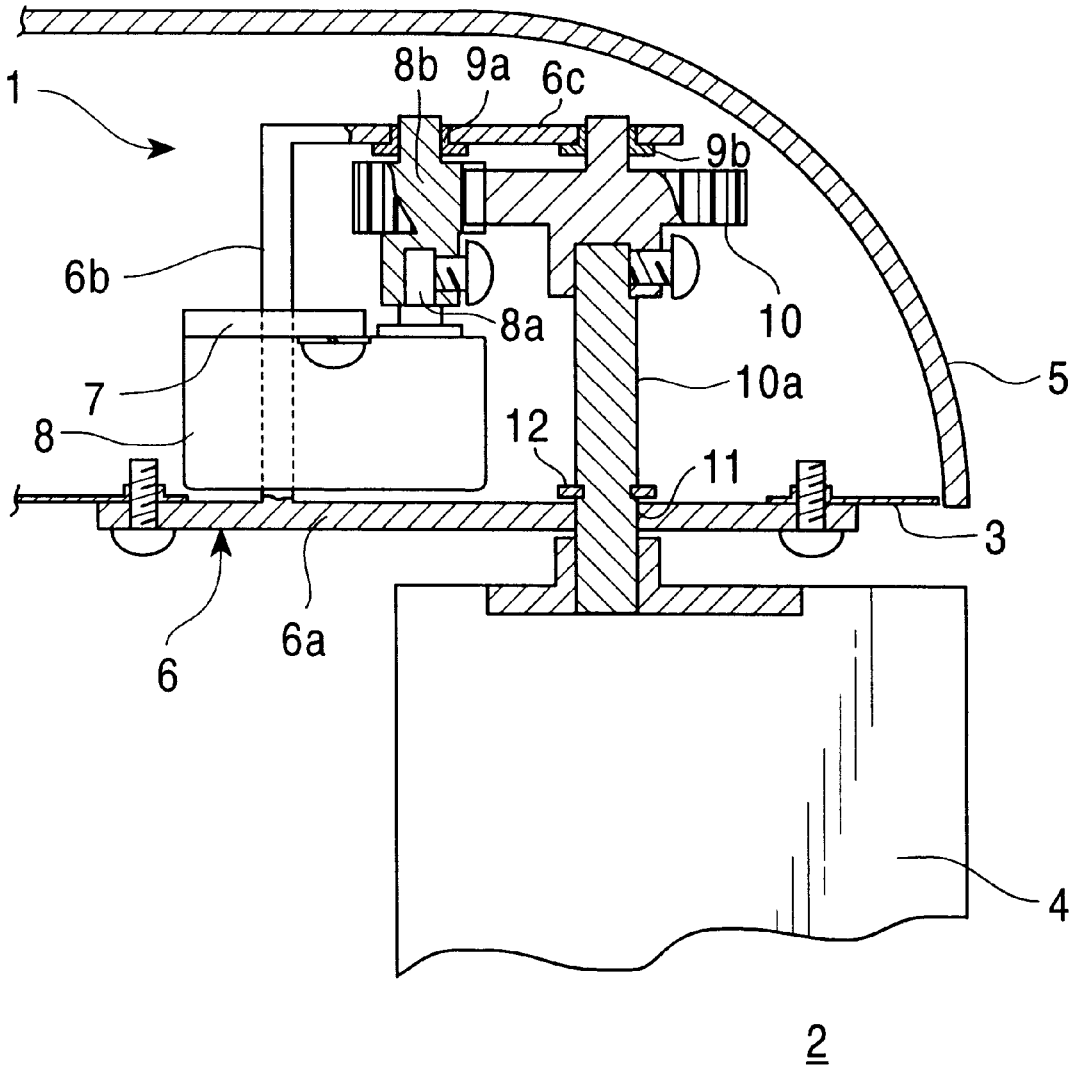
FIG. 17 Prior Art
FIG. 17 is a sectional view of a flap driving means used in the conventional air conditioner.

On explaining the structure of the coupling means 35, in FIGS. 15 and 16, the hinge plate 311 provided at the right end of the wind directing plate member 30L is referred to as 35L, and the hinge plate 311 provided at the left end of the wind plate member 30R is referred to as 35R for convenience of explanation.

According to the embodiment, the hinge plate 35R is vertically provided on the beam member 312 similarly to the other hinge plate 311, and the rotating shaft 313 positioned on the horizontal axis of rotation X of the flap 30 is provided at the upper end thereof. Though the hinge plate 35L is also vertically provided on the beam member 312, it is not provided with the rotational shaft 313, and is formed to be geometrically similar to the hinge plate 35R in a size smaller as a whole.

A fit recess 351 in which the entire body of the hinge plate 35L is fitted is formed on the hinge plate 35R side, thereby coupling the hinge plate 35R and the hinge plate 35L in such a way as they appear to be one hinge plate.

In this case, a male and female means for positioning is provided on each of the opposing faces of the fit recess 351 of the hinge plate 35R and the hinge plate 35L fitted therein, thereby facilitating the positioning of both of the fit recess 351 and the hinge plate 351. In this example, the male and female fitting means consists of a boss 352 provided on the fit recess 351 side and a fit hole 353 formed on the hinge plate 35L side coaxially with the boss 352.

The coupling means 35 is provided with an engaging hook 354, for example, which is on the wind directing plate member 30L, and which is inserted into and engaged in the body base plate 30R. In this example, two of the engaging hooks 354 are provided on the wind directing plate member 30 L side, while on the wind directing plate member 30R side, a pair of engaging recesses 355 and 355 are provided as counterparts of the engaging hooks 354 and 354.

Accordingly, with this coupling means 35, by forcing the wind directing plate member 30L into the wind directing plate member 30R, the hinge plate 35L is integrally coupled with the fit recess 351 of the hinge plate 35R in such a way as the hinge plate 35L is held inside the fit recess 351 of the hinge plate 35R.

Further, in this embodiment, the wind directing plate member 30L is provided with tongue portions 356 for bonding, which is inserted into the wind directing plate member 30R side, at both sides of the engaging hooks 354 in order to increase the coupling strength. An adhesive is applied to the tongue portions 356 to glue the wind directing plate members 30L and 30R.

As described in the above, the flap 30 is composed of a pair of the wind directing plate members 30L and 30R, and each of the rotating shafts 313 provided at the middle hinge plates 311 is fittingly held by the holding plate 26 vertically provided at the drain pan 246 as shown in FIG. 2 described in the above.

Although particular preferable embodiments of the invention have been disclosed thus far, it is to be understood that the present invention is not intended to be limited to the aforementioned embodiments, and various changes and modifications easily made by those who are skilled in the art are also included in the scope of the present invention. For example, in the aforementioned embodiments, the air conditioner is a ceiling mounted type of unit, but the present invention is applicable to a wall mounted type or a floor standing type of an indoor unit.

What is claimed is:

1. An air conditioner comprising:

a box-shaped housing including an air inlet, an air outlet, an air passage communicating with the air inlet and air outlet, and a side plate forming a part of the air outlet and having a burring hole, a heat exchanger situated in the housing, an air fan situated in the housing, a wind vertically directing plate vertically rotatable around a horizontal axis of rotation situated inside the air outlet, and driving means for the wind vertically direction plate including a motor base having a gear housing portion with a bottom and an open face, and a bearing hole, said motor base being attached on an outer face of the side plate with the open face opposing the side plate; a motor attached on an outer face of the bottom of the motor base and having a driving shaft inserted into the gear housing portion; a pinion gear fitted onto the driving shaft and having a projecting portion coaxially with the pinion gear at a head portion side thereof, said projecting portion providing a pinpoint contact with the side plate; and an output gear engaging the pinion gear and having an output shaft with two ends supported by the burring hole of the side plate and the bearing hole of the motor base, said output shaft passing through the side plate, extending into the air outlet and being connected to the wind vertically directing plate.

2. The air conditioner according to claim 1, wherein said projecting portion is in a cone shape.

3. The air conditioner according to claim 1, wherein stopper means for limiting a rotation range of said output gear is provided between said output gear and the bottom of said motor base.

4. The air conditioner according to claim 1, wherein said output gear comprises a sector gear which has a portion without teeth in a circumferential direction, with a stopper portion protruding to the bottom of said motor base being provided at one end of a gear portion, and with an arc-shaped rib facing said stopper portion being formed on the bottom side of said motor base almost along the length of an arc of the aforementioned portion without teeth, and said output gear is attached in said gear housing portion with a proper rotational angle maintained by said rib and said stopper portion.

5. The air conditioner according to claim 1, wherein said pinion gear includes a fitting hole corresponding to the driving shaft, said driving shaft and said fitting hole having flat faces parallel to an axial direction thereof, and said projecting portion has a mark for positioning parallel to the flat faces.

6. An air conditioner comprising:

a box-shaped housing including an air inlet, an air outlet, an air passage communicating with the air inlet and air outlet, and a side plate forming a part of the air outlet and having a burring hole, a heat exchanger situated in the housing, an air fan situated in the housing, a wind vertically directing plate vertically rotatable around a horizontal axis of rotation situated inside the air outlet, and driving means for the wind vertically direction plate including a motor base having a gear housing portion with a bottom and an open face, and a bearing hole, said motor base being attached on an outer face of the side plate with the open face opposing the side plate; a motor attached on an outer face of the bottom of the motor base and having a driving shaft inserted into the gear housing portion; a pinion gear fitted onto the driving shaft; and an output gear engaging the pinion gear and having an output shaft with two ends supported by the burring hole of the side plate and the bearing hole, said output shaft passing through the side plate, extending into the air outlet and being connected to the wind vertically directing plate, wherein at least one of said pinion gear and said output gear is formed of synthetic resin having self-lubricity.

7. An air conditioner comprising:

a box-shaped housing including an air inlet, an air outlet with a side opening and a bottom opening, an air passage communicating with the air inlet and air outlet, a side plate forming a part of the air outlet and having a burring hole, and side and bottom faces, said side opening and bottom opening being opened along the side and bottom faces, a heat exchanger situated in the housing, an air fan situated in the housing, a wind vertically directing plate vertically rotatable around a horizontal axis of rotation situated inside the air outlet, said wind vertically directing plate being rotated to one of an initial position where the wind vertically directing plate blocks the bottom opening, middle positions where the wind vertically directing plate is at positions between the bottom opening and the side opening, and open positions where the wind vertically directing plate is located above a virtual horizontal surface including the horizontal axis of rotation, and driving means for the wind vertically direction plate including a motor base having a gear housing portion with a bottom and an open face, and a bearing hole, said motor base being attached on an outer face of the side plate with the open face opposing the side plate; a motor attached on an outer face of the bottom of the motor base and having a driving shaft inserted into the gear housing portion; a pinion gear fitted onto the driving shaft; an output gear engaging the pinion gear and having an output shaft with two ends supported by the burring hole of the side plate and the bearing hole, said output shaft passing through the side plate, extending into the air outlet and being connected to the wind vertically directing plate; and spring means attached to the output gear for providing momentum to the wind vertically directing plate in a direction of the initial position when the wind vertically directing plate is at least at the open positions.

8. The air conditioner according to claim 7, wherein said spring means comprises a coil spring fitted onto the output shaft of said output gear, with one end of the coil spring being fixed to said output gear, and with the other end thereof being engaged in a slit formed on a side wall of said motor base.

9. The air conditioner according to claim 8, wherein said slit is formed in the portion corresponding to a range where said wind vertically directing plate is rotated from the aforementioned initial position to the position just before the aforementioned open positions, and the range corresponding to the portion where the slit is formed is designated as a lost motion range where said coil spring is not worked.

10. The air conditioner according to claim 8, wherein a holding groove for engagingly holding a coil portion of said coil spring is provided around the output shaft of said output gear.

11. An air conditioner comprising:

a box-shaped housing including an air inlet, an air outlet, an air passage communicating with the air inlet and air outlet, and a side plate forming a part of the air outlet and having a burring hole and a flange around the burring hole, a heat exchanger situated in the housing, an air fan situated in the housing, a wind vertically directing plate vertically rotatable around a horizontal axis of rotation situated inside the air outlet, and driving means for the wind vertically direction plate including a motor base having a gear housing portion with a bottom and an open face, a bearing hole, and a flange around the bearing hole, said motor base being attached on an outer face of the side plate with the open face opposing the side plate; a motor attached on an outer face of the bottom of the motor base and having a driving shaft inserted into the gear housing portion; a pinion gear fitted onto the driving shaft; and an output gear engaging the pinion gear and having an output shaft with two ends supported by the flanges of the burring hole of the side plate and the bearing hole, said output shaft passing through the side plate, extending into the air outlet and being connected to the wind vertically directing plate.

* * * * *